US009945244B2

(12) United States Patent
Roberts et al.

(10) Patent No.: US 9,945,244 B2
(45) Date of Patent: Apr. 17, 2018

(54) TURBINE SHROUD ASSEMBLY AND METHOD FOR LOADING

(71) Applicant: GENERAL ELECTRIC COMPANY, Schenectady, NY (US)

(72) Inventors: Frederic Woodrow Roberts, Simpsonville, SC (US); Victor John Morgan, Simpsonville, SC (US); Matthew Troy Hafner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 322 days.

(21) Appl. No.: 14/825,636

(22) Filed: Aug. 13, 2015

(65) Prior Publication Data

US 2017/0044923 A1 Feb. 16, 2017

(51) Int. Cl.
*F01D 11/22* (2006.01)
*F01D 25/04* (2006.01)

(52) U.S. Cl.
CPC ..... *F01D 11/22* (2013.01); *F05D 2240/11* (2013.01); *F05D 2260/50* (2013.01); *F05D 2300/6033* (2013.01)

(58) Field of Classification Search
CPC ..... F01D 11/22; F05D 2240/11
See application file for complete search history.

(56) References Cited

U.S. PATENT DOCUMENTS 4,127,357 A * 11/1978 Patterson ..... F01D 11/22 415/116
4,334,822 A * 6/1982 Rossmann ..... F01D 11/22 415/113
6,000,227 A * 12/1999 Kroeker ..... H01L 21/67115 62/62

(Continued)

FOREIGN PATENT DOCUMENTS

GB 869908 * 6/1961
GB 2099515 * 12/1982

(Continued)

OTHER PUBLICATIONS

Combined Search and Examination Report issued in connection with corresponding GB Application No. 1613063.5 dated Feb. 16, 2017.

*Primary Examiner* — Woody Lee, Jr.
*Assistant Examiner* — Brian O Peters
(74) *Attorney, Agent, or Firm* — McNees Wallace & Nurick LLC

(57) ABSTRACT

A turbine shroud assembly is disclosed including an inner shroud having a surface adjacent to a hot gas path, an outer shroud, and a biasing apparatus. The biasing apparatus is arranged and disposed to bias the inner shroud in a direction away from the hot gas path, loading the inner shroud to the outer shroud. In another embodiment, the biasing apparatus is a springless biasing apparatus including at least one bellows, at least one thrust piston, or a combination of at least one bellows and at least one thrust piston. A method for (Continued)

loading the turbine shroud assembly is disclosed including biasing the inner shroud having a surface adjacent to a hot gas path in a direction away from the hot gas path toward the outer shroud, wherein biasing the inner shroud includes a biasing force exerted by the biasing apparatus.

20 Claims, 3 Drawing Sheets

(56) References Cited

U.S. PATENT DOCUMENTS

| | | | | |
|---|---|---|---|---|
| 6,113,349 | A | 9/2000 | Bagepalli et al. | |
| 6,217,279 | B1 | 4/2001 | Ai et al. | |
| 6,315,519 | B1 | 11/2001 | Bagepalli et al. | |
| 6,502,823 | B1 * | 1/2003 | Turnquist | F01D 11/025 277/355 |
| 6,758,653 | B2 | 7/2004 | Morrison | |
| 7,044,709 | B2 | 5/2006 | Bruce et al. | |
| 7,278,820 | B2 | 10/2007 | Keller | |
| 7,448,849 | B1 * | 11/2008 | Webster | F01D 11/005 415/128 |
| 7,563,071 | B2 | 7/2009 | Campbell et al. | |
| 8,047,773 | B2 | 11/2011 | Bruce et al. | |
| 8,272,835 | B2 * | 9/2012 | Smith | F01D 11/22 192/85.59 |
| 8,555,477 | B2 * | 10/2013 | Bates | F01D 11/22 277/413 |
| 8,998,565 | B2 * | 4/2015 | Foster | F01D 11/08 415/116 |
| 2010/0303612 | A1 | 12/2010 | Bhatnagar et al. | |
| 2013/0177384 | A1 | 7/2013 | Coign et al. | |

FOREIGN PATENT DOCUMENTS

| | | | |
|---|---|---|---|
| GB | 2 240 818 | A | 8/1991 |
| JP | S61-152907 | A | 7/1986 |
| WO | WO 2014186004 | * | 11/2014 |
| WO | 2015/102949 | A2 | 7/2015 |

* cited by examiner

TURBINE SHROUD ASSEMBLY AND METHOD FOR LOADING

FIELD OF THE INVENTION

The present invention is directed to turbine components. More particularly, the present invention is directed to turbine components having an inner shroud loaded to an outer shroud.

BACKGROUND OF THE INVENTION

In gas turbines, certain components, such as the shroud surrounding the rotating components in the hot gas path of the combustor, are subjected to extreme temperatures, chemical environments and physical conditions. Inner shrouds are subjected to further mechanical stresses from pressures applied to load the inner shroud to the outer shroud, pushing against the pressure of the hot gas path. Pressurizing the space between the inner shroud and the outer shroud leaks high pressure fluid into the hot gas path, decreasing efficiency of the turbine. Further, mechanisms for mechanically loading the inner shroud against the outer shroud, such as springs, exhibit decreased effectiveness at high temperatures, and the springs themselves may creep over time, leading to insufficient loading pressure.

BRIEF DESCRIPTION OF THE INVENTION

In an exemplary embodiment, a turbine shroud assembly includes an inner shroud having a surface adjacent to a hot gas path, an outer shroud, and a biasing apparatus. The biasing apparatus is arranged and disposed to bias the inner shroud in a direction away from the hot gas path, loading the inner shroud to the outer shroud.

In another exemplary embodiment, a turbine shroud assembly includes an inner shroud having a surface adjacent to a hot gas path, an outer shroud, and a springless biasing apparatus. The springless biasing apparatus includes at least one bellows, at least one thrust piston, or a combination of at least one bellows and at least one thrust piston, and is arranged and disposed to bias the inner shroud in a direction away from the hot gas path, loading the inner shroud to the outer shroud.

In another exemplary embodiment, a method for loading a turbine shroud assembly includes biasing an inner shroud having a surface adjacent to a hot gas path in a direction away from the hot gas path toward an outer shroud. Biasing the inner shroud includes a biasing force exerted by a biasing apparatus.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a turbine shroud assembly. Embodiments of the present disclosure, for example, in comparison to concepts failing to include one or more of the features disclosed herein, increase efficiency, increase durability, increase temperature tolerance, reduce the possibility of loss of load, reduce overall cost, and eliminate the need for pressurizing the shroud, produce other advantages, or a combination thereof.

Figure 1:
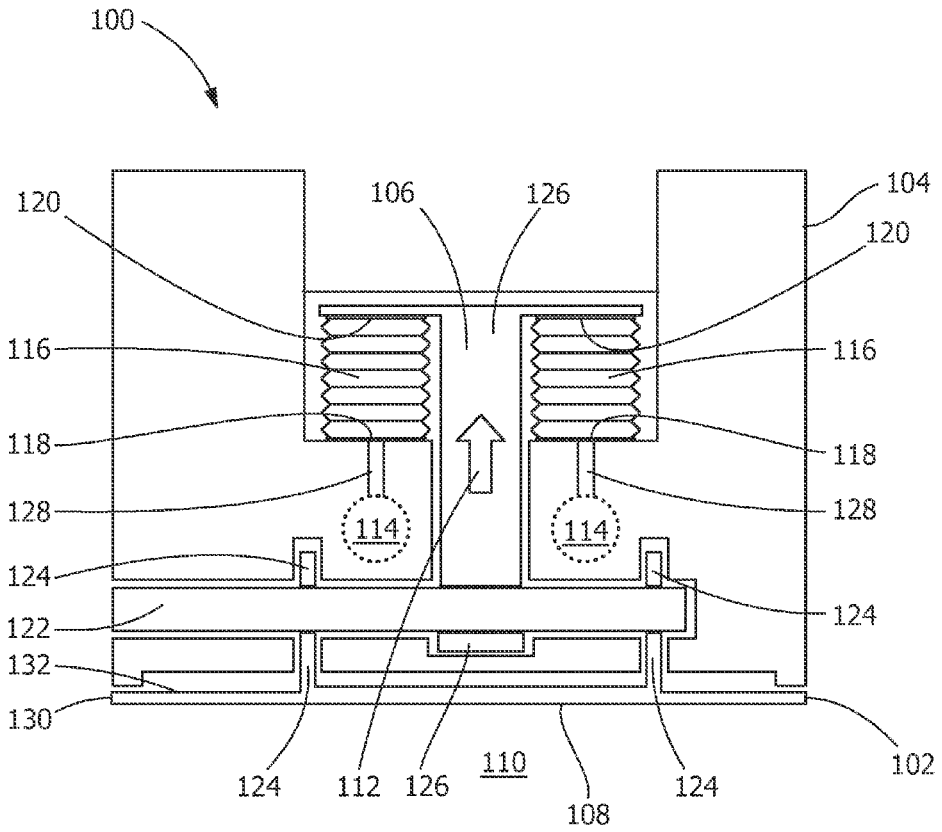
FIG. 1 is a sectioned view of turbine shroud assembly, according to an embodiment of the disclosure.

Referring to FIG. 1, a turbine shroud assembly 100 includes an inner shroud 102, an outer shroud 104, and a biasing apparatus 106. The inner shroud 102 includes a surface 108 adjacent to a hot gas path 110. The biasing apparatus 106 is arranged and disposed to bias the inner shroud 102 in a direction 112 away from the hot gas path 110, loading the inner shroud 102 against the outer shroud 104. The biasing apparatus 106 may be connected to the inner shroud 102 by any suitable attachment, including, but not limited to, a pin 122, a hook, a dovetail, a t-slot, or combinations thereof.

In one embodiment, the biasing apparatus 106 exerts a biasing force on the inner shroud 102 sufficient to dampen vibrations of the inner shroud 102 against the outer shroud 104. Without being bound by theory, it is believed that the vibrations of the inner shroud 102 are caused in part by the varying pressure field resulting from buckets/blades rotating in close proximity to the inner shroud 102. In another embodiment, contact between the inner shroud 102 and the outer shroud 104 reduces ingestion of hot gasses from the hot gas path 110 into the shroud assembly 100.

In one embodiment, either or both of the inner shroud 102 and the outer shroud 104 includes a ceramic matrix composite, a metal, a monolithic material, or a combination thereof. As used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC).

In one embodiment, the surface 108 includes an environmental barrier coating (EBC) which protects the surface 108 from water vapor, heat, and other combustion gases. In another embodiment, the surface 108 includes a thermal barrier coating (TBC) which protects the surface 108 from heat. In yet another embodiment, at least one of the EBC and the TBC coats the exterior 130 of the inner shroud 102, including both the surface 108 as well as the distal surface 132.

In one embodiment, the turbine shroud assembly 100 includes a springless biasing apparatus 106. As used herein, a "springless" biasing apparatus 106 is a biasing apparatus 106 in which the biasing force loading the inner shroud 102 against the outer shroud 104 is not generated by a spring. In certain embodiments, a springless biasing apparatus 106 may include a spring provided that any included spring does not generate a biasing force loading the inner shroud 102 against the outer shroud 104.

In one embodiment, the biasing apparatus 106 is driven by a pressurized fluid 114. The pressurized fluid 114 may be any fluid, including, but not limited to, air. Suitable sources for pressurized air include air from a gas turbine compressor.

In one embodiment, the biasing apparatus 106 includes at least one bellows 116. In a further embodiment, the at least one bellows 116 includes a first end 118 attached to the outer shroud 104 and a second end 120 configured to expand away from the hot gas path 110 in response to an increased internal pressure within the at least one bellows 116. The second end 120 of the at least one bellows 116 may be attached to at least one pin 122 which connects to at least one projection 124 of the inner shroud 102. In one embodiment, the second end 120 is attached to the at least one pin 122 by a stanchion 126.

Figure 2:
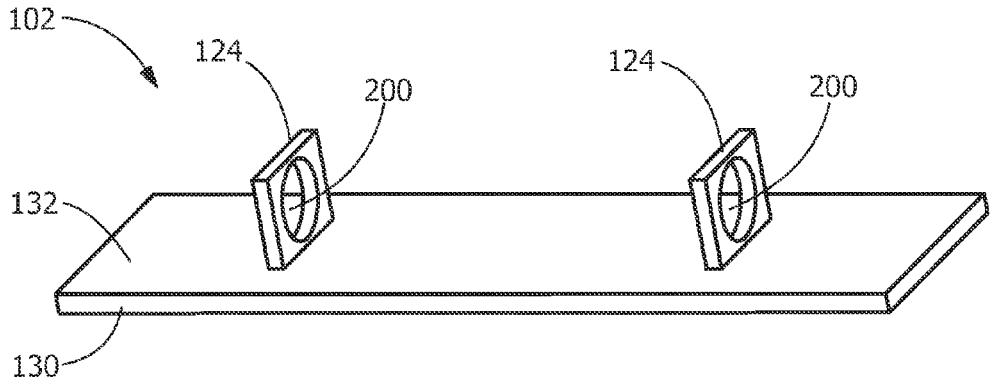
FIG. 2 is a perspective view of the inner shroud of FIG. 1, according to an embodiment of the disclosure.

Referring to FIG. 2, in one embodiment the at least one projection 124 of the inner shroud 102 includes an insertion aperture 200. The insertion aperture 200 is arranged and disposed such that the at least one pin 122 may be inserted through the insertion aperture 200 to reversibly attach the inner shroud 102 to the second end 120.

Referring again to FIG. 1, in one embodiment, the at least one bellows 116 hermetically caps a pressurized fluidic supply line 128. As used herein, "hermetically caps" indicates that there is little or no leakage of pressurized fluid 114 from the region where the at least one bellows 116 joins with the pressurized fluidic supply line 128, and that there is also little or no leakage of pressurized fluid 114 from the at least one bellows 116.

Figure 3:
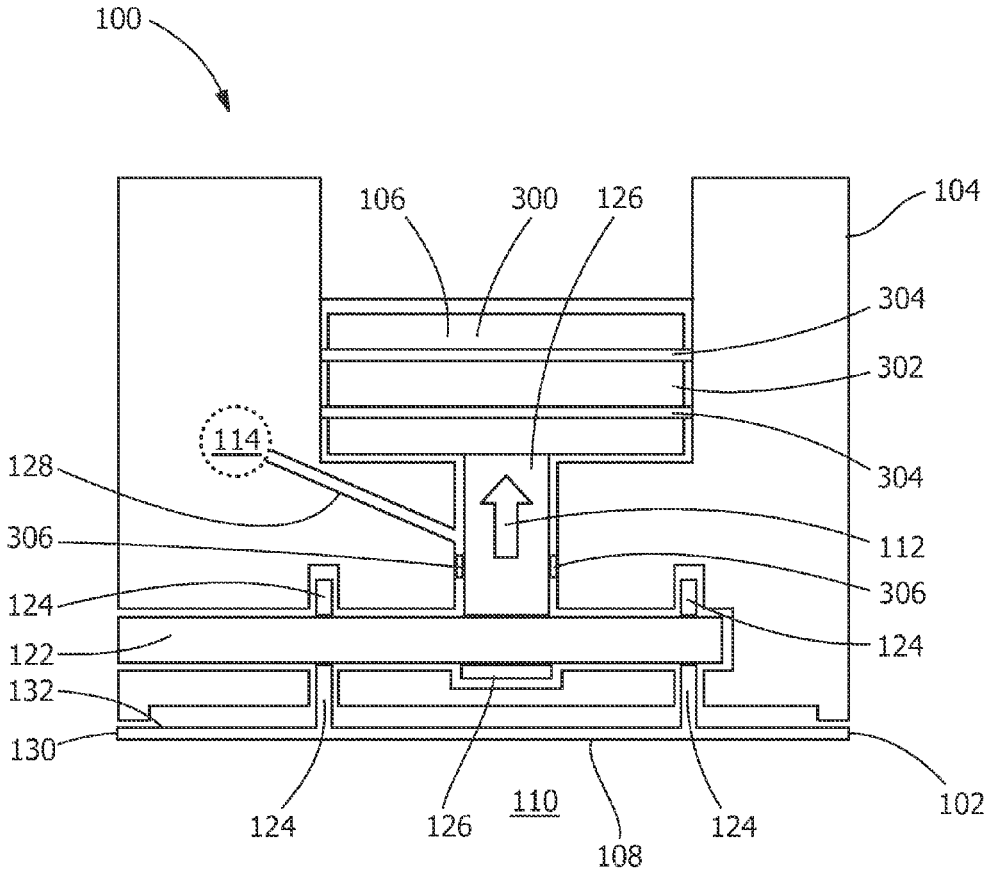
FIG. 3 is a sectioned view of turbine shroud assembly, according to an embodiment of the disclosure.

Referring to FIG. 3, in another embodiment, the biasing apparatus 106 includes at least one thrust piston 300. The at least one thrust piston 300 includes a piston head 302 and at least one piston seal 304. The at least one thrust piston 300 is configured to urge stanchion 126 in a direction 112 away from the hot gas path 110 in response to an increased pressure from the pressurized fluid 114. The piston head 302 may be attached to at least one pin 122 which connects to at least one projection 124 of the inner shroud 102. In one embodiment, the piston head 302 is attached to the at least one pin 122 by a stanchion 126.

In the embodiment shown in FIG. 3, the at least one thrust piston 300 includes a pressurized fluid seal 306 disposed between the piston head 302 and the at least one pin 122. The pressurized fluid seal 306 reduces leakage of the pressurized fluid 114 to the hot gas path 110. Without being bound by theory, it is believed that leakage from the pressurized fluid seal 306 is dependent on the pressure differential across the pressurized fluid seal 306, the circumference of the pressurized fluid seal 306 and operational wear. In another embodiment, the pressurized fluid seal 306 includes at least one of a lubricant and a non-galling metal pair.

Referring to FIGS. 1 and 3, a method for loading a turbine shroud assembly 100 includes biasing the inner shroud 102 in a direction 112 away from the hot gas path 110 toward the outer shroud 104, wherein biasing the inner shroud 102 includes a biasing force exerted by the biasing apparatus 106. The biasing force is proportional to the pressure of the pressurized fluid 114. In one embodiment, the pressurized fluid 114 is sourced at a fixed location in the gas turbine compressor, and the biasing force varies with the pressure generated by the gas turbine compressor. In another embodiment, the biasing force may be controlled by adjusting the pressure of the pressurized fluid 114.

In one embodiment, loading a turbine shroud assembly 100 by biasing the inner shroud 102 in a direction 112 away from the hot gas path 110 toward the outer shroud 104 reduces damaging vibrations in the inner shroud 102, in comparison to a turbine shroud assembly 100 in which the inner shroud 102 is biased in a direction toward the hot gas path 110 away from the outer shroud 104. Without being bound by theory, it is believed that such damaging vibrations may be exacerbated in a turbine shroud assembly 100 in which the space between the inner shroud 102 and the outer shroud 104 is not pressurized by a fluid, such as, by way of example only, pressurized fluid 114.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly, comprising: an inner shroud having a surface adjacent to a hot gas path; an outer shroud; and a biasing apparatus, wherein the biasing apparatus is disposed entirely within the outer shroud, is arranged and disposed to bias the inner shroud in a direction away from the hot gas path, loading the inner shroud against and in direct contact with the outer shroud at least at a trailing edge and a leading edge of the outer shroud.

2. The turbine shroud assembly of claim 1, wherein the biasing apparatus is a springless biasing apparatus.

3. The turbine shroud assembly of claim 1, wherein the biasing apparatus is driven by a pressurized fluid.

4. The turbine shroud assembly of claim 1, wherein the biasing apparatus includes at least one bellows.

5. The turbine shroud assembly of claim 4, wherein the at least one bellows includes a first end attached to the outer shroud, and a second end configured to expand away from the hot gas path in response to an increased internal pressure within the at least one bellows, the second end connecting to the inner shroud and configured to exert a biasing force on the inner shroud.

6. The turbine shroud assembly of claim 5, wherein the second end of the at least one bellows is connected to the inner shroud by an attachment selected from the group consisting of a pin, a hook, a dovetail, a t-slot, and combinations thereof.

7. The turbine shroud assembly of claim 4, wherein the at least one bellows hermetically caps a pressurized fluidic supply line.

8. The turbine shroud assembly of claim 1, wherein the biasing apparatus includes at least one thrust piston connected to the inner shroud and configured to exert a biasing force on the inner shroud, the at least one thrust piston includes, disposed entirely within the outer shroud, at least one piston head, at least one piston seal, and a stanchion, and the at least one piston head is disposed radially outward of the stanchion from the hot gas path.

9. The turbine shroud assembly of claim 8, wherein the thrust piston is connected to the inner shroud by an attachment selected from the group consisting of a pin, a hook, a dovetail, a t-slot, and combinations thereof.

10. A turbine shroud assembly, comprising: an inner shroud having a surface adjacent to a hot gas path; an outer shroud; and a springless biasing apparatus including at least one bellows, at least one thrust piston, or a combination of at least one bellows and at least one thrust piston, wherein the springless biasing apparatus is disposed entirely within the outer shroud, and is arranged and disposed to bias the inner shroud in a direction away from the hot gas path, loading the inner shroud against and in direct contact with the outer shroud.

11. The turbine shroud assembly of claim 10, wherein the springless biasing apparatus is driven by a pressurized fluid.

12. The turbine shroud assembly of claim 10, wherein the springless biasing apparatus at least comprises the at least one bellows, and the at least one bellows includes a first end attached to the outer shroud, and a second end configured to expand away from the hot gas path in response to an increased internal pressure within the at least one bellows, the second end connecting to the inner shroud and configured to exert a biasing force on the inner shroud.

13. The turbine shroud assembly of claim 12, wherein the at least one bellows hermetically caps a pressurized fluidic supply line.

14. The turbine shroud assembly of claim 12, wherein the at least one bellows is connected to the inner shroud by an attachment selected from the group consisting of a pin, a hook, a dovetail, a t-slot, and combinations thereof.

15. The turbine shroud assembly of claim 10, wherein the springless biasing apparatus at least comprises the at least one thrust piston, the at least one thrust piston includes, disposed entirely within the outer shroud, at least one piston head, at least one piston seal, and a stanchion, the at least one piston head is disposed radially outward of the stanchion from the hot gas path, and the thrust piston is connected to the inner shroud and configured to exert a biasing force on the inner shroud.

16. The turbine shroud assembly of claim 15, wherein the thrust piston is connected to the inner shroud by an attachment selected from the group consisting of a pin, a hook, a dovetail, a t-slot, and combinations thereof.

17. A method for loading a turbine shroud assembly, comprising biasing an inner shroud having a surface adjacent to a hot gas path in a direction away from the hot gas path toward an outer shroud and loading the inner shroud against and in direct contact with the outer shroud at least at a trailing edge and a leading edge of the outer shroud, wherein biasing the inner shroud includes a biasing force exerted by a biasing apparatus disposed entirely within the outer shroud.

18. The method of claim 17, wherein the biasing apparatus is a springless biasing apparatus.

19. The method of claim 17, wherein the biasing apparatus is driven by a pressurized fluid.

20. The method of claim 17, wherein the biasing apparatus includes at least one bellows, at least one thrust piston, or a combination of at least one bellows and at least one thrust piston.

* * * * *